United States Patent [19]

Ono et al.

[11] Patent Number: 4,672,796

[45] Date of Patent: Jun. 16, 1987

[54] CONTROL METHOD OF STOP WAITING OPERATION IN COLLECTIVE PACKING MACHINE

[75] Inventors: Shuichi Ono, Tokyo; Satoru Aida, Sanjo; Kinshiro Hoshino, Nakanokuchi, all of Japan

[73] Assignees: The Japan Tobacco & Salt Public Corporation, Tokyo; Sanjo Machine Works Ltd., Nigata, both of Japan

[21] Appl. No.: 906,602

[22] Filed: Sep. 10, 1986

Related U.S. Application Data

[63] Continuation of Ser. No. 634,955, Jul. 27, 1984, abandoned.

[30] Foreign Application Priority Data

Jul. 28, 1983 [JP] Japan ..... 58-138607

[51] Int. Cl.[4] ..... B65B 11/58; B65B 57/16

[52] U.S. Cl. ..... 53/449; 53/494; 53/499

[58] Field of Search ..... 53/498, 499, 171, 494, 53/449

[56] References Cited

U.S. PATENT DOCUMENTS 3,142,948 8/1964 Arnett ..... 53/499 X 3,570,209 3/1971 Salwasser ..... 53/540 X

*Primary Examiner*—John Sipos

*Attorney, Agent, or Firm*—Balogh, Osann, Kramer, Dvorak, Genova & Traub

[57] ABSTRACT

A control method of operation of a collective packing machine, which packing machine is composed of a main packing machine and an auxiliary packing machine. The main packing machine is in continuous operation while the auxiliary packing machine is in stop waiting operation wherein the auxiliary packing machine is operated in matching and synchronization with the main packing machine. When the auxiliary packing machine is at the stop waiting state, the revolution speed of a main shaft of the main packing machine and the revolution speed of an input shaft of a clutch of the auxiliary packing machine are controlled by comparing and matching therebetween. When an output shaft of the clutch is stopped and operation of the auxiliary packing machine is started, operation starting time of the auxiliary packing machine is made earlier than the normal operation starting time by time $t_s$. The time $t_s$ depends on the operation speed of the main packing machine so as to enable synchronization of the main packing machine with the auxiliary packing machine at the time of finishing to connect the clutch of the auxiliary packing machine. After finishing to connect the clutch, the main packing machine and the auxiliary packing machine are controlled in synchronization.

2 Claims, 8 Drawing Figures

CONTROL METHOD OF STOP WAITING OPERATION IN COLLECTIVE PACKING MACHINE

This application is a continuation of application Ser. No. 634,955, filed July 27, 1984, now abandoned.

BACKGROUND OF THE INVENTION

The present invention relates to a control method of stop waiting operation in a collective packing machine where articles packed in specified size by a main packing machine (front packing machine) are packed in collective packing (using a packing paper of specified size) by an auxiliary packing machine (rear packing machine).

In order to control the operation of such a collective packing machine in the prior art, a control method of stop waiting operation has been adopted.

A control method of stop waiting operation is characterized in that packed articles fed continuously at regular intervals from a main packing machine in continuous operation are received, in an auxiliary packing machine; the auxiliary packing machine in stop waiting state is started for operation when packed articles in the required number are received, and after finishing one cycle operation of auxiliary packing to perform collective packing of the packed articles the auxiliary packing machine is in stop waiting state at a predetermined definite position.

In such operation control method, however, a condition must be satisfied that one cycle time of the auxiliary packing shall be less than one lot cycle of the main continuous packing of articles in the prescribed number and lines in the main packing machine.

For example, in order to perform collective packing of packed articles of one lot being two stages by five lines, the auxiliary packing machine must finish the collective packing of articles in two stages by five lines before the main packing machine finishes to manufacture packed articles in two stages by five lines being ten pieces.

If one cycle time of the auxiliary packing is delayed in comparison to one lot cycle of the main packing, normal flow of packed articles at an article delivery position becomes impossible and operation of the main packing machine must be stopped. In order to satisfy the above-mentioned condition and expect a stable operation, the waiting time before starting one cycle of the auxiliary packing must be as long as possible, and since one cycle time of the auxiliary packing is made less than one lot cycle of the main packing the operation speed of the auxiliary packing machine must be rapid.

This tendency becomes more significant as high speed operation advances, and therefore it adversely affects the auxiliary packing machine in its operation and mechanism.

The driving method of the auxiliary packing machine in the prior art is such that a motor of the auxiliary packing machine is in a continuous operation state and the clutch/brake mechanism, for example, is connected or thereto disconnected whereby drive transmission to an acting member is controlled.

In the drive transmission method using such clutch/-brake mechanism, however, a time interval between the clutch connection starting and the connection finishing (slip between input and output shafts being zero and the revolution speed being equal) is inevitably required.

The connection finishing time becomes longer as high speed operation advances. Consequently, ratio of the connection finishing time in one cycle time of the auxiliary packing becomes large, and in order to satisfy the above-mentioned condition the speed ratio between the main packing machine and the auxiliary packing machine must be further increased.

In phase relation between the auxiliary packing machine and the main packing machine, since the auxiliary packing machine must be operated in synchronization as soon as possible after the operation starting, the operation speed of the auxiliary packing machine must be further increased so as to recover the phase delay of the auxiliary packing machine. Since times for stopping and starting per minute increase as the high speed operation advances, the operation condition of the auxiliary packing machine becomes further disadvantageous.

In some collective packing machines of the prior art, the auxiliary packing machine can be operated continuously. In order to eliminate disadvantages caused by intermittent operation of stopping or starting a reservoir of large capacity is installed in an intermediate portion of a delivery path between the main packing machine and the auxiliary packing machine. The operation speed of the main packing machine or the auxiliary packing machine is variable in correspondence to the pool amount in the reservoir which is controlled constantly so as to enable the continuous operation of the auxiliary packing machine within the desired extent.

In this type of packing machine, existence of the reservoir requires a large installation area and increases the overall cost of the facilities thereby various disadvantages are involved in its practical use. In view of the disadvantages of such packing machine, a control method of stop waiting operation as described previously is preferred.

SUMMARY OF THE INVENTION

An object of the present invention is to provide a control method of stop waiting operation in a collective packing machine which can perform collective packing at high speed by adopting the control method of stop waiting operation as its basis and eliminating the above-mentioned disadvantages in the method.

The main feature of the first invention is in a control method of operation of a collective packing machine comprising a main packing machine and an auxiliary packing machine each having an individual driving source, the main packing machine being in continuous operation and the auxiliary packing machine being in stop waiting operation, the auxiliary packing machine being operated in matching and synchronization with the main packing machine, wherein when the auxiliary packing machine is at stop waiting state, revolution speed of a main shaft of the main packing machine and revolution speed of an input shaft of a clutch of the auxiliary packing machine are controlled in matching; when an output shaft of the clutch is stopped and operation of the auxiliary packing machine is started, operation starting time of the auxiliary packing machine is made earlier the normal operation time by a time $t_s$, the time $t_s$ depending on the operation speed of the main packing machine so as to enable synchronization of the main packing machine with the auxiliary packing machine at the time of finishing to connect the clutch of the auxiliary packing machine; and after finishing to connect the clutch, the main packing machine and the auxiliary packing machine are controlled in synchronization.

The main feature of the second invention is in a control method of stop waiting operation in a collective packing machine wherein in addition to the first invention as main requirements an auxiliary packing machine has the function of continuous operation decision thereby the auxiliary packing machine can be operated continuously.

DETAILED DESCRIPTION OF THE INVENTION

The method of the invention will now be described specifically by way of an embodiment referring to the accompanying drawings.

The embodiment is a collective packing machine to perform collective packing of articles in two stages by five lines (n lines in general).

Figure 1:
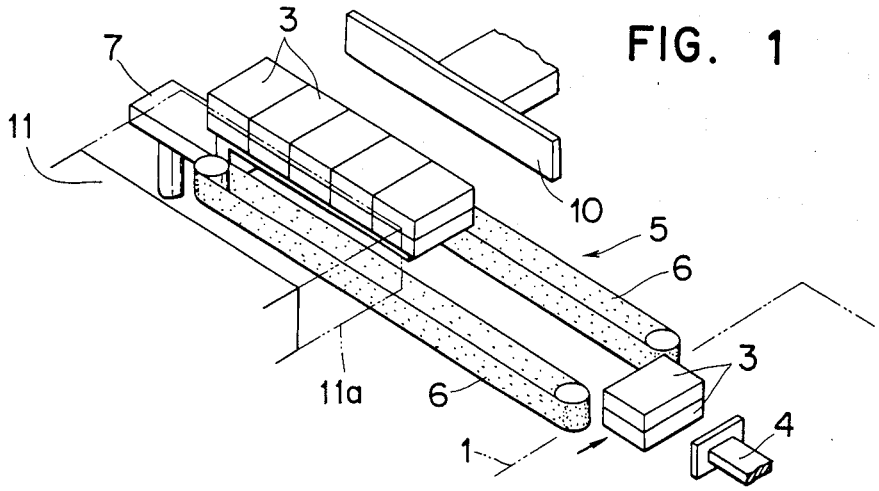
FIG. 1 is a perspective view of a collective packing machine at a delivery transferring portion as an embodiment of the invention.
Figure 2:
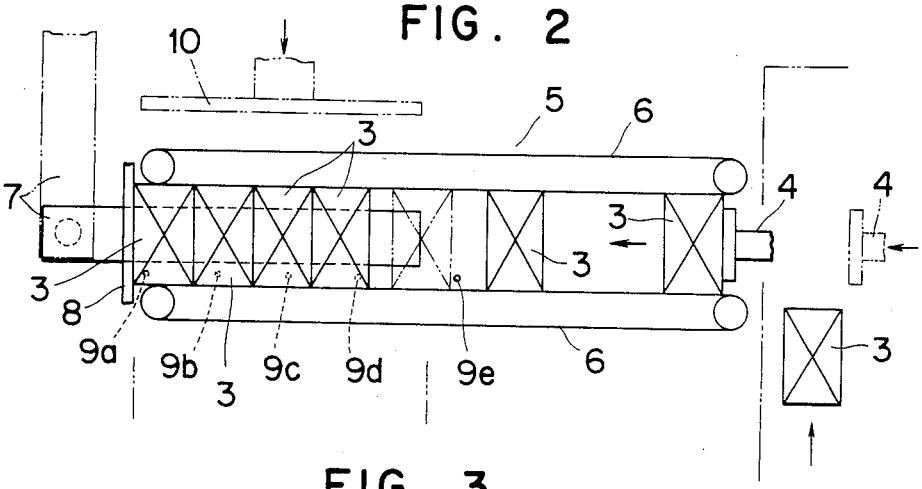
FIG. 2 is a plan view of the collective packing machine.
Figure 3:
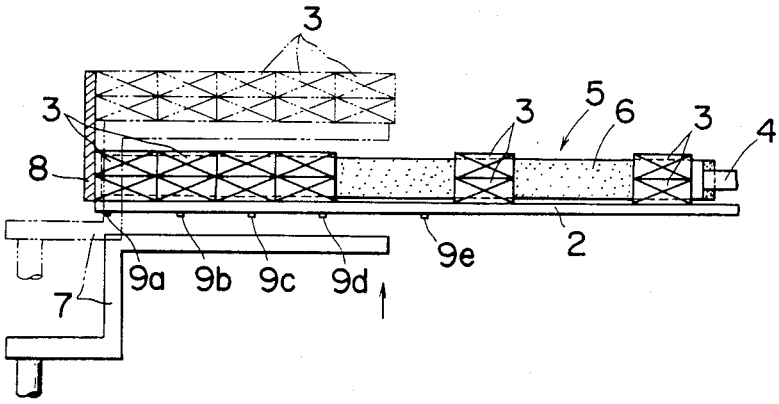
FIG. 3 is a sectional view of the collective packing machine in a lateral direction.
Figure 4:
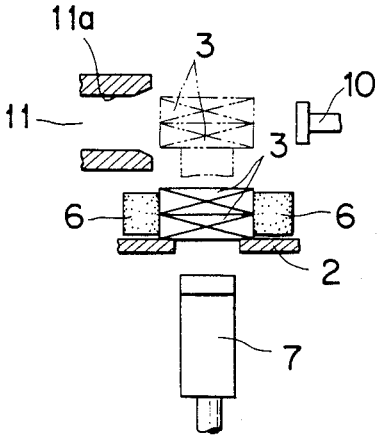
FIG. 4 is a sectional view of the collective packing machine in a longitudinal direction.

FIG. 1 shows a perspective view of the collective packing machine at a delivery portion from a main packing machine to an auxiliary packing machine. FIG. 2 shows a plan view of the collective packing machine. FIG. 3 shows a sectional view of the collective packing machine in a lateral direction. FIG. 4 shows a sectional view of the collective packing machine in a longitudinal direction.

Packed articles 3 in two stages by one line are fed from a main packing machine 1 to a conveyor plate 2 at regular intervals and then pushed by pushing action of a pusher 4 of the main packing machine 1 onto a delivery conveying member 5 and transferred by a grasping belt 6 of the delivery conveying member 5 onto a lifting and turning plate 7 and stopped at a prescribed position by a stopper 8. This operation is repeated and the packed articles 3 on front line serve as a stopper for those on rear line such that the packed articles 3 in two stages by five lines are aligned at the prescribed position on the lifting and turning plate 7.

Arrival detecting sensors 9*a*, 9*b*, 9*c*, 9*d*, 9*e* (photo sensors in this case) for packed articles 3 confirm position of the articles 3 of n lines in collective packing.

Each installation interval of the arrival detecting sensors 9*a*, 9*b*, 9*c*, 9*d*, 9*e* is made broader than width of the packed articles 3 of one line so as to avoid simultaneous action of two arrival sensors or more.

Furthermore, the arrival detecting sensor 9*e*, of the last line, i.e. 5th line is installed at a predetermined position upstream of the position the packed article 3 of the 5th line is going to arrive.

If the packed articles 3 of n lines, two stages by five lines in this case, are detected in position, the lifting and turning plate 7 moves upwards to lift the packed articles 3 of five lines above the conveyor plate 2 as shown in FIG. 3. A feed pusher 10 projects and pushes the packed articles 3 at the upper limit and feeds them onto a packing path 11*a* of an auxiliary packing machine 11 as shown in FIG. 4. After the projection feeding, the feed pusher 10 goes back and at the same time the lifting and turning plate 7 is turned reversely by 90 degrees in the horizontal direction as shown in FIG. 2 and stopped at the original position below the conveyor plate 2. The lifting and turning plate 7 moves up and down and is turned so as to avoid interference with the packed articles 3 fed continuously at regular intervals by the delivery conveying member 5 even during the lifting operation.

And then the packed articles 3 in two stages by five lines are packed in collective packing at the packing path 11*a*.

Figure 5:
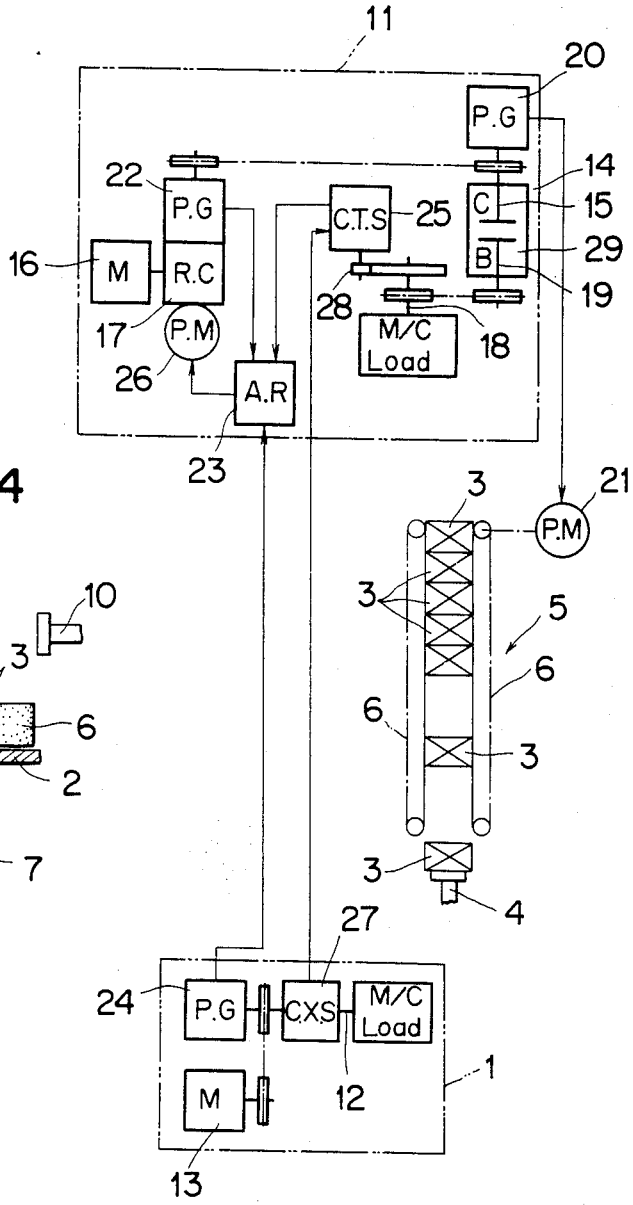
FIG. 5 is a schematic driving system diagram.

FIG. 5 shows outline of a driving system diagram.

A main shaft 12 of the main packing machine 1 is rotated by a motor 13, and an input shaft 15 of a clutch 14 in the auxiliary packing machine 11 is rotated by a motor 16 through a speed change gear 17.

A main shaft 18 of the auxiliary packing machine 11 is rotated through an output shaft 19 of the clutch 14.

The grasping belt 6 of the delivery conveying member 5 is driven by a speed variable motor 21 rotating in matching with the rotation of the input shaft 15 of the clutch 14 according to a speed detector 20. Consequently, if synchronization of the main packing machine 1 with the auxiliary packing machine 11 is held, the passage time of the packed article 3 in nth line from actuating the arrival detecting sensor 9*e* to passing through it becomes constant in phase angle of the auxiliary packing machine 11 irrespective of the belt speed.

Rotation of the input shaft 15 of the clutch 14 is fed back to a speed/phase comparator 23 by a speed detector 22, and rotation of the main shaft 12 of the main packing machine 1 is entered into the speed/phase comparator 23 by a speed detector 24. Rotation of the main shaft 18 of the auxiliary packing machine 11 is also entered thereinto by a phase detector 25, and rotation of the input shaft 15 of the clutch 14 is compared with that of the main shaft 12 of the main packing machine 1 and controlled in matching by a speed adjusting motor 26. The main shaft 18 of the auxiliary packing machine 11 and the main shaft 12 of the main packing machine 1 are compared and controlled in phase by the phase detectors 25 and 27.

A gear mechanism 28 is interposed for the phase comparison at the same revolution speed.

Consequently, the revolution speed of the input shaft 15 of the clutch 14 of the auxiliary packing machine 11 is controlled by comparing and matching driving with that of the main shaft 12 of the main packing machine 1 (at the stop waiting state of the auxiliary packing machine 11), and the output shaft 19 of the clutch 14 is stopped by letting out the clutch 14.

Figure 6:
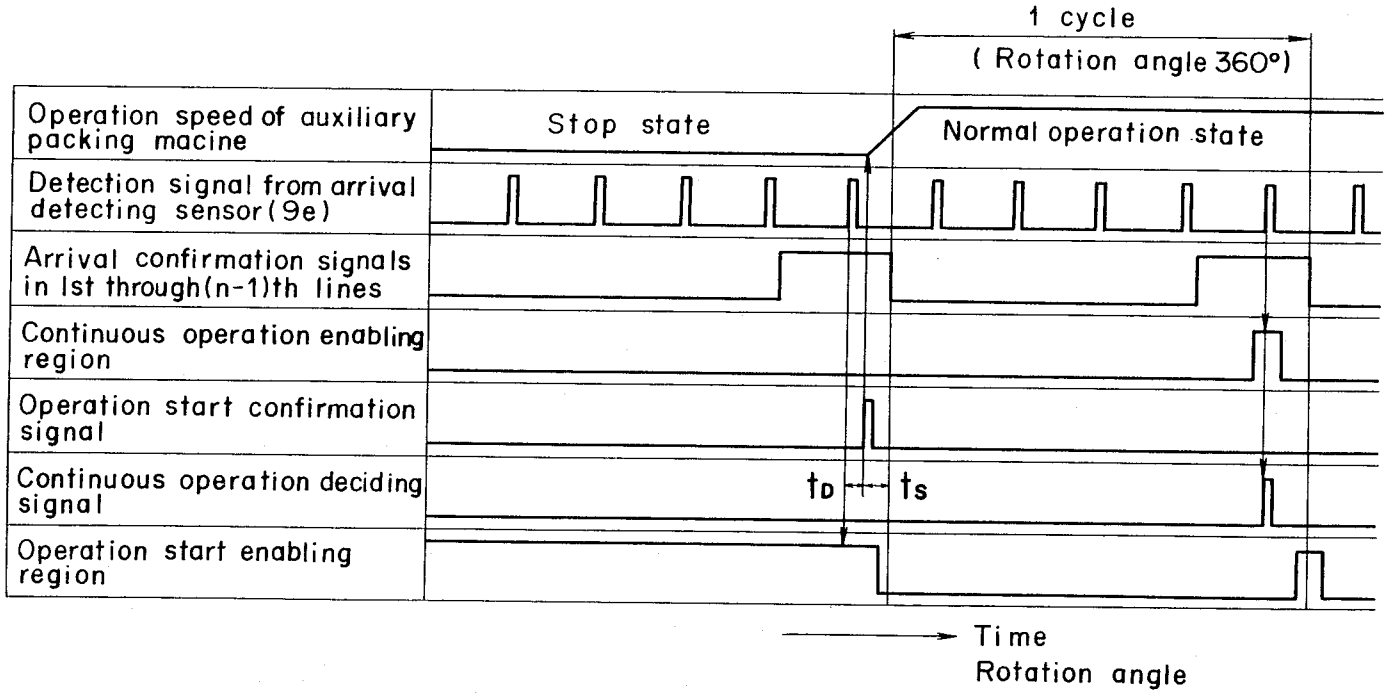
FIG. 6 is a working chart of an auxiliary packing machine at operation starting and continuous operation.
Figure 7:
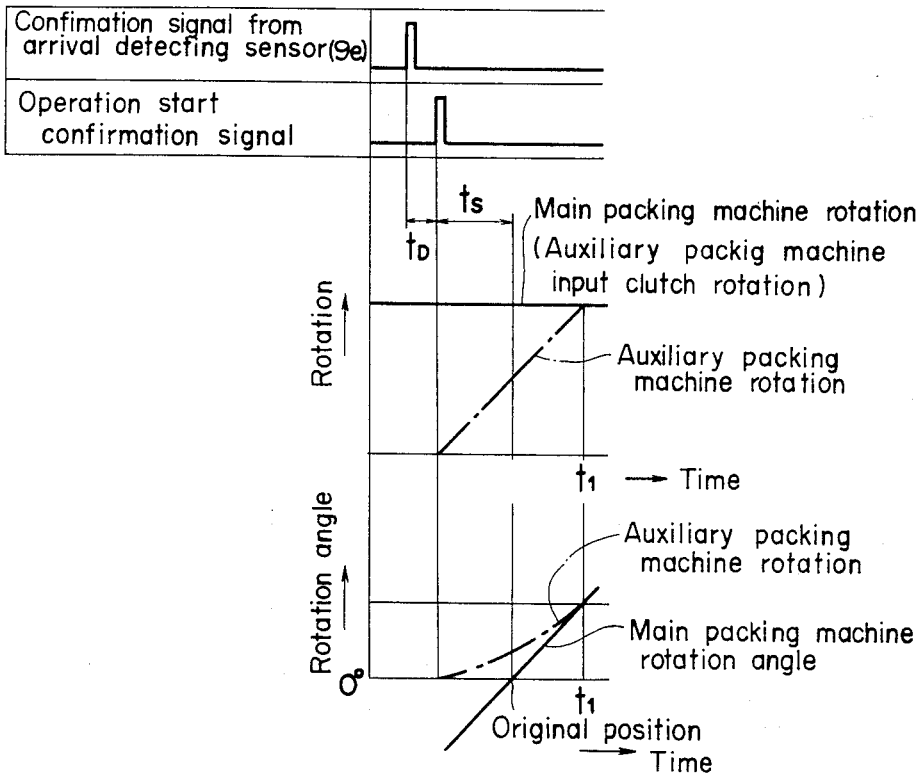
FIG. 7 is a diagram of signals, speed and rotation angle at the operation starting.

FIG. 6 shows a working chart of the auxiliary packing machine at the state where the auxiliary packing machine is started for operation and the continuous operation is facilitated and performed. FIG. 7 shows a diagram of signals, speed and rotation angle at the operation starting state.

The operation starting state and the continuous operation state of the auxiliary packing machine 11 may be specified by following conditions:

(1) . . . At 1st through (n−1)th lines, four arrival detecting sensors 9*a*, 9*b*, 9*c*, 9*d* act.

(2) . . . At nth line, the arrival detecting sensor 9*e* acts.

(3) . . . The auxiliary packing machine 11 is in a region adjacent to the main packing machine to enable the continuous operation required in the mechanism.

(4) . . . The auxiliary packing machine 11 is in the region to enable the operation starting (stop region at a predetermined definite position) required in the mechanism.

The operation starting state is specified by conditions (1), (2), (4); the continuous operation state is done by conditions (1), (2), (3).

The speed ratio of the grasping belt 6 of the delivery conveying member 5 must be set so that arriving of the packed articles 3 at 1st through 4th lines has been confirmed by the arrival detecting sensors 9*a*, 9*b*, 9*c*, 9*d* and when the packed articles 3 at nth line, 5th line in this case, comes to the arrival detecting sensor 9*e*.

Operation starting signal for the auxiliary packing machine 11 which starts the connection of clutch 14 is earlier than normal operation starting time by time $t_s$ due to the upstream predetermined position of sensor 9*e*.

The normal operation starting time means that operation of the auxiliary packing machine 11 starts at a rotation angle 0° of the main packing machine 1 corresponding to angle 0° in one cycle of the auxiliary packing machine 11. Consequently, the operation starting signal is generated earlier than the rotation angle 0° of the main packing machine 1 by the time $t_s$.

This is enabled by installing the arrival detecting sensor 9*e* before the definite (arrival) position. In order to set the time $t_s$, operation starting signal is generated later than confirmation signal of the arrival detecting sensor 9*e* by an adjusted time $t_D$ so that synchronization between the main packing machine 1 and the auxiliary packing machine 11 is obtained depending on operation speed of the auxiliary packing machine 11 and at time $t_1$ when connection of the clutch 14 is finished and operation of the auxiliary packing machine 11 is just started.

Selection of the time $t_D$ is previously programmed, and when the operation speed is detected the operation starting time corresponding to each speed is determined and the operation starting signal of the auxiliary packing machine 11 is generated. Thereby the synchronous control property of the auxiliary packing machine 11 is improved.

The synchronous control is started after the operation starting and at the time $t_1$ when rotation of the output shaft 19 of the clutch 14 coincides completely with that of the main shaft 18 of the auxiliary packing machine 11.

At the second cycle from the operation starting or later, if the conditions (1), (2), (3) are satisfied the continuous operation enabling signal is generated and the auxiliary packing machine 11 is still operated continuously.

The operation will be described referring to FIGS. 6 and 7. The packed articles 3 are pushed out of the main packing machine 1 continuously at regular intervals and then fed in sequence onto the conveyor plate 2 by the grasping belt 6 of the delivery conveying member 5. When the packed articles 3 are aligned by means of the stopper 8, the arrival detecting sensor 9*e* detects any packed article 3 passing above the sensor 9*e* and generates the confirmation signal.

If the packed article 3 at (n−1)th line, 4th line on 2nd stage in this case, comes to the respective definite position on the conveyor plate 2 and is confirmed in position by the arrival detecting sensors 9*a*, 9*b*, 9*c*, 9*d*, arrival signals on 1st through (n−1)th lines are entirely generated.

If the packed articles 3 at nth line, 5th line in this case, is confirmed by the arrival detecting sensor 9*e* and in the operation start enabling region (stop region at the definite position) of the auxiliary packing member 11, that is, if the conditions (1), (2), (4) are satisfied, the operation starting signal is generated.

The operation starting signal is generated at a delay of the adjusted time $t_D$ if the conditions (1), (2), (4) are satisfied. In this case, the operation starting signal is generated at a delay of the time $t_D$ after the arrival detecting sensor 9*e* confirms the packed article 3 at 5th line.

As a result, the operation is started earlier than the normal operation starting time by the time $t_s$.

After the operation is started as above described, synchronous control is started at the time of entire coincidence of rotation of the output shaft 19 of the clutch 14, that is, at the time $t_1$ of finishing to connect the clutch 14, and the synchronous control is still performed at any position of the rotation angle during the continuous operation.

Figure 8:
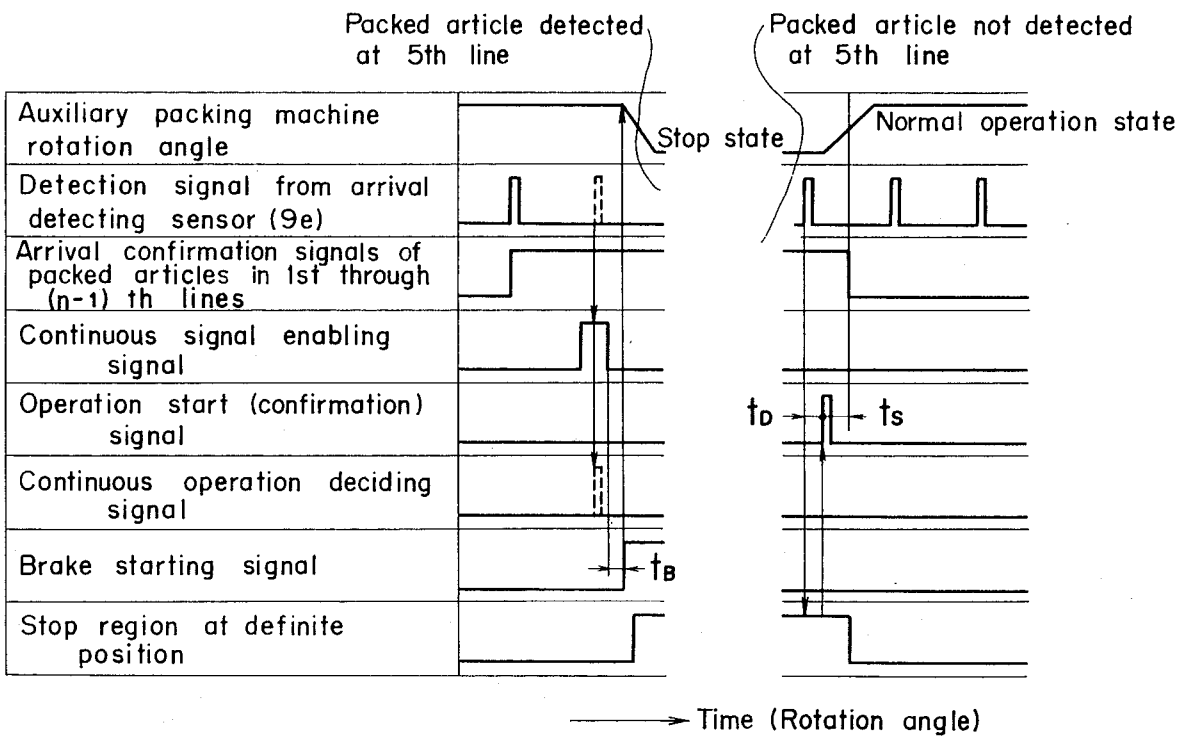
FIG. 8 is a working chart of the auxiliary packing machine at the operation starting state.

FIG. 8 shows a working chart of the auxiliary packing machine when the operation is stopped and started again.

Operation of the auxiliary packing machine 11 is stopped, if any of the conditions (1), (2), (3) is not satisfied.

The clutch 14 is let out and the brake 29 is let in.

In this case, restriction of the stopping region at the definite position shall be considered out of necessity of considering the reoperation of the machine.

In other words, the continuous operation enabling region of the auxiliary packing machine 11 shall be earlier than the starting rotation angle position of the brake 29 so as to stop the auxiliary packing machine 11 at the definite position. If the brake starting signal to stop the auxiliary packing machine at the definite position is generated and then decision is performed regarding whether or not the continuous operation is possible, restarting cannot be performed on account of the stopping region being at the definite position for the decision regarding whether or not the continuous operation is possible even if the brake starting signal is generated.

Consequently, time $t_B$ must be reserved.

Operation of the collective packing machine will be described referring to FIG. 8. In this case, the comfirmation signal of the arrival detecting sensor 9*e* is not generated, that is, the condition (2) is not satisifed thereby the auxiliary packing machine 11 is stopped.

If the arrival detecting sensor 9*e* does not detect the packed article 3 and the continuous operation enabling region lapses, after time $t_B$ from the lapse the brake starting signal is generated and the auxiliary packing machine 11 is in a stop waiting state within the stop region at the definite position. Subsequently, if the packed article 3 on nth line is fed and detected by the arrival detecting sensor 9*e*, the confirmation signal is generated and the reoperation is started in a similar manner to the operation starting as above described.

When the auxiliary packing machine 11 is outside the continuous operation enabling region and signals of the conditions (1), (2) are generated outside the stop region at the definite position, the auxiliary packing machine 11 is stopped at the definite position and the trouble display is performed.

In the present invention as above described, when the auxiliary packing machine 11 is at the stop waiting state, the revolution speed of the main shaft 12 of the main packing machine 1 and the revolution speed of the input shaft 15 of the clutch 14 of the auxiliary packing machine 11 are controlled by matching them; when the output shaft 19 of the clutch 14 is stopped and the operation of the auxiliary packing machine 11 is started, operation starting time of the auxiliary packing machine 11 is made earlier than the normal operation starting time by a time $t_s$, the time $t_s$ depending on the operation speed of the main packing machine 1 so as to enable synchronization of the main packing machine 1 with the auxiliary packing machine 11 at the time of finishing to connect the clutch 14 of the auxiliary packing machine 11; and after finishing to connect the clutch 14, the main packing machine 1 and the auxiliary packing machine 11 are controlled in synchronization. In this constitution, the operation speed of the auxiliary packing machine 11 need not be increased excessively in comparison to that of the main packing machine 1 in order to recover the phase delay of the auxiliary packing machine 11 with respect to the main packing machine 1. Consequently, control property in synchronization and matching is improved and the control in synchronization and matching is readily performed even at the time when operation of the machine is just started.

After finishing to connect the clutch 14, that is, when the input shaft 15 and the output shaft 19 of the clutch 14 are rotated integrally and approximate synchronization is obtained, synchronous control between the main packing machine 1 and the auxiliary packing machine 11 is started. Thereby operation characteristics in synchronization and matching between the main packing machine 1 and the auxiliary packing machine 11 can be improved, and disadvantages of the auxiliary packing machine 11 in the operating condition during high speed operation may be eliminated.

The auxiliary packing machine 11 has a function of continuous operation decision, thereby the auxiliary packing machine 11 can be operated continuously and disadvantages in intermittent operation may be eliminated.

Thus the invention can fully attain the desired object.

What is claimed is:

1. In a method of control of the operation of a collective packing machine of the type having a first packing machine with a first driving source, and a first main shaft rotated by said first driving source, a second packing machine with a second driving source and a second main shaft rotated by said second driving source, and a clutch placed between said second driving source and the second main shaft of said second packing machine and having an input shaft rotated by said second driving source and an output shaft connected to the second main shaft, and wherein said first packing machine operates continuously to produce plural sets of packed articles one by one, said plural sets of packed articles being delivered one by one with spacings therebetween and being aligned in front of the said second packing machine, and said second packing machine operates for stop waiting operation to pack plural sets (n) of the packed articles aligned in front thereof in each cycle of the operation thereof, said first main shaft and said second main shaft being rotated at a predetermined ratio of speed with respect to each other during operation of said second packing machine, said second packing machine being controlled to start and to stop its operation by connecting and disconnecting said clutch;

which method comprises the steps of controlling, while said second packing machine is in stop waiting state, the speed of revolution of the input shaft of said clutch by comparing the speed of revolution of said first main shaft with the speed of revolution of said input shaft of said clutch so as to maintain the ratio of these two speeds at a predetermined value;

starting, when operation of said second packing machine is to be started, connection of said clutch earlier by a time increment Ts in advance of rotation of angle 0° of said first main shaft corresponding to rotation angle 0° of said second main shaft in one cycle of said second packing machine, said time increment Ts being selected depending on the speed of revolution of the first main shaft of said first packing machine so as to bring operation of said second packing machine into synchronization with the operation of said first packing machine at the time of completion of connecting said clutch, said time of completion of connecting said clutch being when speed of the output shaft of said clutch coincides completely with rotation of the input shaft of said clutch, said second packing machine completion its operation at the same time as starting of connecting said clutch; and maintaining, following the completion of connecting said clutch, the operation of said second packing machine to synchronization with said first packing machine by varying the ratio of speed between said first packing machine and said second packing machine by increasing or decreasing the speed of said second packing machine.

2. A method according to claim 1, further including the step of disconnecting said clutch when the nth packed article has not delivered on time with first through (n−1)th sets of packed articles aligned in front of said second packing machine, such that inertia revolution of said second main shaft is controlled to bring said second packing machine into said stop waiting state.

* * * * *